US011662187B1

(12) United States Patent
Pineda

(10) Patent No.: US 11,662,187 B1
(45) Date of Patent: May 30, 2023

(54) FEED NECK MODULE FOR TOY GUN

(71) Applicant: HK Army Inc., Signal Hill, CA (US)

(72) Inventor: Jason Jeremiah Pineda, Signal Hill, CA (US)

(73) Assignee: HK Army Inc., Signal Hill, CA (US)

( * ) Notice: Subject to any disclaimer, the term of this patent is extended or adjusted under 35 U.S.C. 154(b) by 0 days.

(21) Appl. No.: 17/936,742

(22) Filed: Sep. 29, 2022

(51) Int. Cl.

| | |
|---|---|
| ***F41B 7/08*** | (2006.01) |
| ***F41B 11/52*** | (2013.01) |
| ***F42B 12/38*** | (2006.01) |
| ***F42B 6/10*** | (2006.01) |
| ***F21K 2/00*** | (2006.01) |
| *F41B 11/89* | (2013.01) |

(52) U.S. Cl.
CPC ..... *F42B 6/10* (2013.01); *F21K 2/00* (2013.01); *F41B 7/08* (2013.01); *F41B 11/52* (2013.01); *F41B 11/89* (2013.01)

(58) Field of Classification Search
CPC .. F41B 7/08; F41B 11/52; F41B 11/57; F41B 11/89; F42B 6/10; F42B 12/38; F42B 12/40; F42B 12/42; F41A 33/02; F41K 2/00; F21K 2/00
USPC ..... 124/41.1, 49, 80, 82, 1; 473/570; 446/473
See application file for complete search history.

(56) References Cited

U.S. PATENT DOCUMENTS 3,240,924 A * 3/1966 Josephr ..... F21V 33/0064 362/112
5,415,151 A * 5/1995 Fusi ..... F42B 12/38 124/16
5,730,321 A * 3/1998 McAllister ..... F41B 9/0078 222/394
5,762,058 A * 6/1998 Cheng ..... F41A 21/32 124/83
5,876,995 A * 3/1999 Bryan ..... B05B 7/2472 435/189
6,048,280 A * 4/2000 Palmer ..... F41B 11/71 124/16
6,247,995 B1 * 6/2001 Bryan ..... B05B 7/2472 435/189

(Continued)

FOREIGN PATENT DOCUMENTS

CN 208998638 U 6/2019

OTHER PUBLICATIONS

Gel Blaster Starfire product page, https://gelblaster.com/, available prior to Sep. 29, 2022 and accessed on Oct. 6, 2022.

*Primary Examiner* — Alexander R Niconovich
(74) *Attorney, Agent, or Firm* — Knobbe, Martens, Olson & Bear, LLP

(57) ABSTRACT

A feed neck module that is easily attached or detached to a toy gun and a loader. The feed neck module has a mounting bracket for the toy gun and threads for the loader. The mounting bracket and threads are compatible with a variety of different toy guns and loaders. Furthermore, the feed neck module has a conduit which allows projectiles (paintballs, airsoft BBs, gel balls, etc.) to travel from the loader to the toy gun. The conduit may include a funnel to control the flow of the projectiles. The projectiles may be made of a luminescent material (e.g., the projectiles glow in the dark). Furthermore, the feed neck module may have a UV light source that radiates light onto the projectiles as they travel through the conduit. The UV light source may fully charge the projectiles before the projectiles enter the toy gun.

20 Claims, 10 Drawing Sheets

(56) References Cited

U.S. PATENT DOCUMENTS 6,298,841 B1 * 10/2001 Cheng ..... F41A 21/32 102/501
6,591,824 B2 * 7/2003 Hatcher ..... F41B 11/52 124/56
6,648,726 B2 * 11/2003 Hornsby ..... F42B 6/10 446/175
7,004,813 B2 * 2/2006 Zuloff ..... F42B 12/38 446/175
7,040,308 B2 * 5/2006 Ciesiun ..... F41B 11/52 124/47
7,178,515 B2 * 2/2007 Carpenter ..... F41B 11/52 124/49
7,278,417 B2 10/2007 Ciesiun
7,870,851 B2 * 1/2011 Mahany ..... F41B 11/68 124/56
7,900,619 B1 * 3/2011 Palmer ..... F42B 12/42 124/16
7,921,838 B2 * 4/2011 Tippmann, Jr. ..... F41B 11/62 124/75
8,371,282 B2 * 2/2013 Meggs ..... F41B 11/641 124/56
8,434,765 B1 * 5/2013 Taylor ..... F41J 9/165 273/362
8,590,519 B2 * 11/2013 Barish ..... F41B 11/52 124/69
8,596,255 B2 * 12/2013 Meggs ..... F42B 6/10 124/56
9,067,127 B2 * 6/2015 Clark ..... F41A 33/02
10,488,146 B2 * 11/2019 Quek ..... F41B 11/646
10,898,763 B2 * 1/2021 Osborn ..... F21K 2/06
11,079,198 B2 * 8/2021 Wood ..... F41B 11/50
11,592,259 B1 * 2/2023 Davis ..... F41B 7/08
2003/0213481 A1 * 11/2003 Bell ..... F41B 11/52 124/56
2011/0016760 A1 * 1/2011 Longo ..... F41A 9/65 102/513
2012/0152221 A1 * 6/2012 Meggs ..... F41A 9/83 206/204
2013/0152912 A1 * 6/2013 Spencer ..... F41B 11/50 124/82
2014/0069406 A1 * 3/2014 Hastings ..... F41B 11/52 124/80

* cited by examiner

FEED NECK MODULE FOR TOY GUN

CROSS-REFERENCE TO RELATED APPLICATIONS

Any and all applications for which a foreign or domestic priority claim is identified in the Application Data Sheet as filed with the present application are hereby incorporated by reference under 37 CFR 1.57.

BACKGROUND

Field

The present disclosure is directed to a feed neck module for a toy gun, and more particularly to a feed neck module that has a light source that emits light onto projectiles that are made of luminescent material and that is removably connected to a rail on a toy gun.

Description of Related Art

Toy guns include paintball guns, gel ball guns, airsoft guns, or dart blasters. Depending on the type of toy gun, the toy gun may fire paintballs, gel balls, airsoft BBs, or darts. The toy guns may be used for a variety of recreational and/or competitive games. Games with toy guns can be played both indoors and outdoors with teams of varying sizes. Many games are played in low-lighting conditions (e.g., at night or an arena with low lighting). To help players track the projectiles fired by them or by other players, the projectiles may be luminescent (e.g., glow in the dark). If the projectiles do not glow brightly enough, players will not be able to track their projectiles or spot the projectiles of other players. Thus, it is important for players to be able to charge their luminescent projectiles quickly and effectively throughout a game session and without having to exit the playing field.

SUMMARY

There is a need for improved charging of luminescent projectiles while participating in games involving toy guns and while remaining in a low-lighting environment.

In accordance with one aspect of the disclosure, a feed neck module for a toy gun is provided. The feed neck module includes a housing. The housing including an opening configured to removably couple to a loader filled with projectiles. The housing also includes a conduit having a first opening and a second opening, wherein the first opening is configured to align with an outlet of the loader when the housing is attached to the loader so that a projectile can pass through the outlet and into the conduit via the first opening, and wherein the second opening is configured to align with an opening of the toy gun when the housing is attached to the toy gun so that the projectile can pass out of the conduit and into the toy gun, and a mounting bracket, wherein the mounting bracket is configured to removably couple to a rail of the toy gun proximate the opening of the toy gun. The feed neck module further includes a light source, wherein the light source emits light onto the projectile passing through the conduit, wherein the projectile includes a luminescent material and absorbs the light, and a sensor configured to activate the light source when the projectile passes through the conduit, and a power source configured to power the light source and the sensor.

In accordance with one aspect of the disclosure, the projectile is made of a material including super absorbent polymers and is configured to burst on impact. Additionally, in some aspects, the projectile is made of plastic or rubber. In accordance with another aspect of the disclosure, the projectile is a sponge ball. Furthermore, in some aspects, the projectile is cylindrical or ball-shaped.

In accordance with one aspect of the disclosure, the light source is an UV LED (ultraviolet light emitting diode). Additionally, in some aspects, the UV LED is configured to fully charge the luminescent material of the projectile. In accordance with one aspect of the disclosure, the power source includes of a removable battery.

In accordance with one aspect of the disclosure, the mounting bracket is configured to slide onto the rail of the toy gun and lock in place via a set screw. Additionally, in some aspects, the mounting bracket is configured to receive a dovetail rail. In accordance with another aspect of the disclosure, the mounting bracket further includes a quick release.

In accordance with one aspect of the disclosure a feed neck module for a toy gun. The feed neck module includes a housing. The housing includes an opening configured to removably couple to a loader filled with projectiles, and a conduit that includes a funnel and having a first opening and a second opening, wherein the first opening is larger than the second opening, wherein the first opening is configured to align with an outlet of the loader when the housing is attached to the loader so that a projectile can pass through the outlet and into the conduit via the first opening, the second opening being configured to align with an opening of the toy gun when the housing is attached to the toy gun so that the projectile can pass out of the conduit and into the toy gun. The housing further including a mounting bracket, wherein the mounting bracket is configured to removably couple to a rail of the toy gun. The feed neck module further includes a UV LED, wherein the UV LED emits UV light onto the projectile passing through the conduit, wherein the projectile includes a luminescent material and absorbs the UV light, and a power source configured to power the UV LED, and a switch configured to connect the power source to the UV LED when the switch is in a first position.

In accordance with one aspect of the disclosure, the projectile is a sphere with a diameter between 6 mm to 9 mm. In accordance with another aspect of the disclosure, the opening is configured to removably couple to the loader via a snap-fit. Additionally, in some aspects, the mounting bracket is configured to slide onto the rail of the toy gun and lock in place via a thumb screw.

In accordance with one aspect of the disclosure, a feed neck module for a launcher of projectiles. The feed neck module includes a housing. The housing includes a top side including a threaded opening configured to removably couple to a loader filled with projectiles that include a luminescent material, and a bottom side including of a mounting bracket, wherein the mounting bracket is configured to removably couple to a rail of the launcher proximate to an opening of the launcher. The housing further includes a funnel having a top opening and a bottom opening, wherein the top opening is configured to align with an outlet of the loader when the housing is attached to the loader so that the projectiles can pass through the outlet and into the funnel via the first opening, and wherein the bottom opening is configured to align with the opening of the launcher so that the projectiles can pass out of the conduit and into the launcher. The feed neck module further includes one or more UV LEDs positioned towards the bottom side of the housing, wherein the one or more UV LEDs emit UV light onto the projectiles passing through the funnel, wherein the projectiles absorb the UV light, and a sensor configured to activate the one or more UV LEDs when one or more projectiles pass through the funnel. The feed neck module also includes one or more batteries configured to power the one or more UV LEDs and the sensor, and a switch configured to connect the one or more batteries to the one or more UV LEDs and the sensor when the switch is in a first position.

In accordance with one aspect of the disclosure, the mounting bracket is configured to slide onto the rail of the launcher and lock in place via a set screw.

DETAILED DESCRIPTION

The present disclosure describes various implementations of a feed neck module for a toy gun or launcher. The feed neck module may be easily attached to or detached from a toy gun and a loader. For example, the feed neck module may have a mounting bracket for the toy gun and threads for the loader. The detachable feed neck module allows a user to quickly replace a broken or malfunctioning feed neck module, toy gun, or loader. Thus, repairs on the toy gun assembly will be quicker and more cost effective. Furthermore, the feed neck module may have a mounting bracket and threads that are compatible with a variety of different toy guns and loaders. Thus, the feed neck module may be used with different sizes and types of loaders and toy guns (e.g., paintball, airsoft, gel ball gun, etc.). The compatibility of the feed neck module allows a user to quickly switch from one game style to another (e.g., paintball to airsoft to gel balls).

Furthermore, the feed neck module has a conduit which allows the projectiles (paintballs, airsoft BBs, gel balls, etc.) to travel from the loader to the toy gun. The conduit may control the flow of the projectiles. For example, the conduit may include a funnel that limits the number of projectiles that may enter the conduit at the same time. The projectiles may be made of a luminescent material (e.g., the projectiles may glow in the dark). Furthermore, the feed neck module may have a light source that radiates and/or directs light (e.g., UV light) onto the projectiles as they travel through the conduit. Thus, the projectiles may absorb the light and glow as they are ejected from the toy gun. Advantageously, the glowing projectiles help users play and compete in low lighting conditions (e.g., nighttime game sessions). For example, the glowing projectiles may improve the aim of the user (e.g., by allowing them to see the path of the projectiles). The glowing projectiles may also help users identify when they have successfully hit another player or target.

Figure 1:
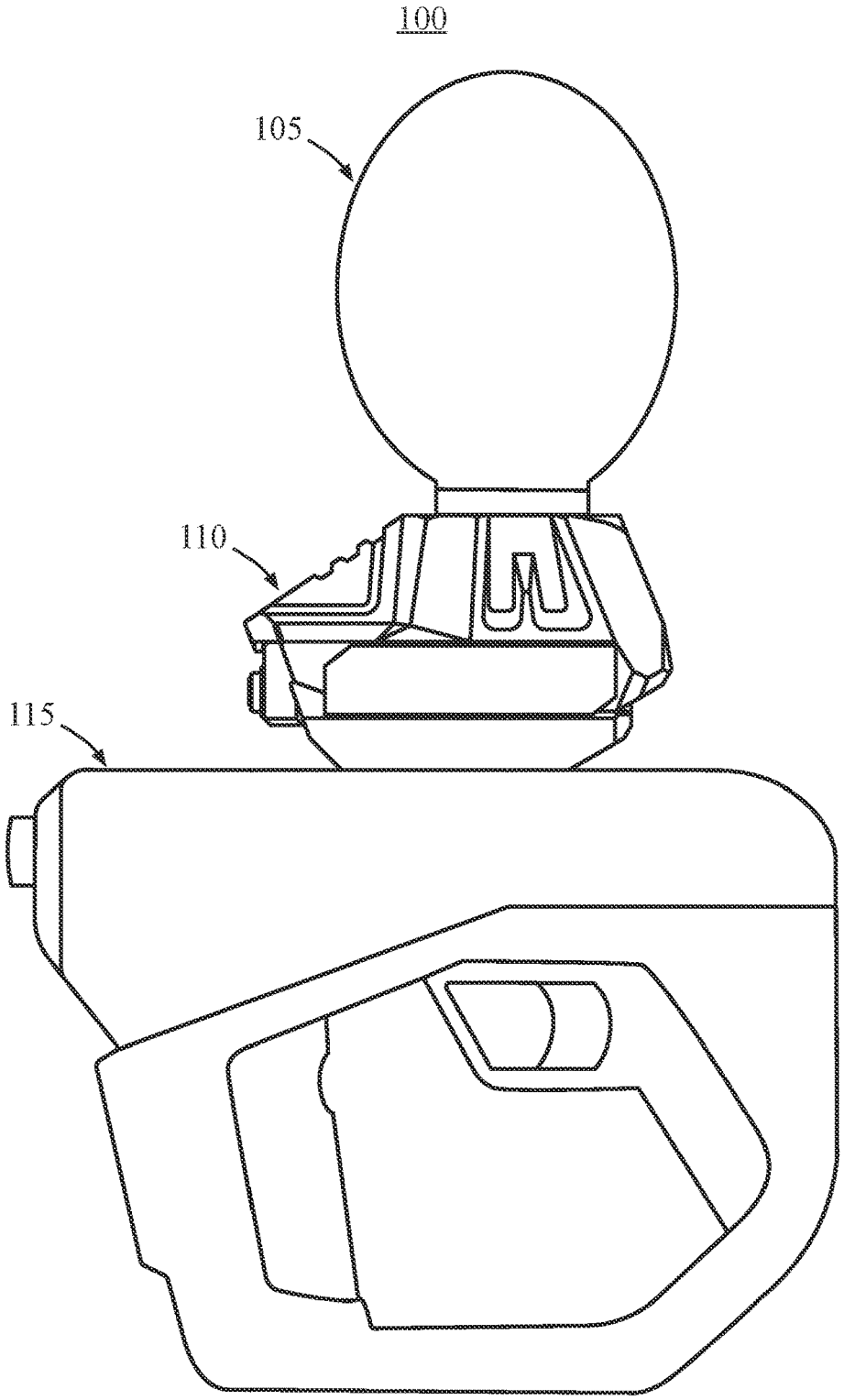
FIG. 1 illustrates a right-side view of a toy gun assembly.

FIG. 1 illustrates a right-side view of the toy gun assembly 100. The toy gun assembly 100 includes the loader 105, the feed neck module 110, and the toy gun 115. In some embodiments, the toy gun 115 is a gel ball launcher (e.g., a gel ball gun or shooter or marker). Alternatively, or in addition, the toy gun 115 may be a paintball gun, an airsoft gun, and/or a foam launcher. The toy gun 115 may be spring powered, battery powered, and/or gas powered (e.g., with compressed air or $CO_2$). For example, in some implementations the toy gun 115 may use an internal electric motor and a spring-loaded piston pump to fire the projectiles. In some embodiments, the toy gun 115 may launch the projectile 2 meters, 5 meters, 10 meters, more than 10 meters, or any distance in between.

The loader 105 may be an ovoid-shaped container that may hold the projectiles. Alternatively, the loader 105 may be cylindrical, spherical, square, or any other shape. In some embodiments, the loader 105 may carry 100, 200, 500, or more than 500 projectiles. The projectiles may be spherical gel balls. Alternatively, or in addition, the gel balls may be cylindrical, ovoid, square, or bullet shaped (e.g., cylindrical with ogive curves). The gel balls may include super absorbent polymers that are dehydrated and expand when introduced to water. In some embodiments, the user may fill the loader with dehydrated gel balls and add water directly to the loader 105. Thus, the dehydrated gel balls may absorb the water and expand within the loader 105. Adding the water to the loader 105 may increase the convenience of reloading the loader 105. For example, the dehydrated gel balls may be smaller than the expanded gel balls and may be easier to pour into the loader 105. In some embodiments, the diameter of the dehydrated gel balls may be 0.5 mm, 1 mm, 3 mm, 5 mm, more than 5 mm, or any size in between. In contrast, the diameter of the expanded gel balls may be 2 mm, 3 mm, 6 mm, 9 mm, 15 mm, or more than 15 mm, or any size in between.

Furthermore, the gel balls may maintain their shape under pressure. Thus, in some embodiments, the gel balls are not deformed during the firing process (e.g., being ejected from the toy gun). Additionally, or alternatively, the gel balls may burst on contact with a player or a target. The gel balls may also, or alternatively, spread the force of impact over a wide surface area to reduce the likelihood of injury to a player or target. Furthermore, the gel balls may have an additive or surface material that leaves a mark on the target or player. The mark may be luminescent. Thus, a user may be able to easily identify if a target or player has been hit.

In some embodiments, the gel balls are made of, or include, a luminescent material. For example, the gel balls may be made of phosphor such as strontium aluminate, copper-activated zinc sulfide, and/or silver-activated zinc sulfide. Alternatively, or in addition, the luminescent material may have oxides, nitrides, oxynitrides, sulfides, selenides, halides or silicates of zinc, cadmium, manganese, aluminum, silicon, or various rare-earth metals. The luminescent material may be charge by being exposed to a light source (e.g., UV light, direct sunlight, etc.). For example, the luminescent material may absorb the light of a light source within the feed neck module 110 and reemit the light over a period of time (e.g., after the projectile has been fired from the toy gun 115).

In some embodiments, the projectiles may be paintballs, airsoft BBs, foam or sponge darts, foam or sponge balls, or foam or sponge disks. The diameter and/or length of the projectiles may be 2 mm, 3 mm, 6 mm, 9 mm, 15 mm, 17 mm, or more than 17 mm, or any size in between. For example, if the projectiles are paintballs, the diameter may range from 0.50 inches to 0.70 inches (12.7 mm to 17.8 mm). Any of these projectile types may be made of, or include, luminescent materials listed above. Alternatively, or in addition, the projectiles may be made of metal, rubber, plastic, gelatin, polyethylene glycol, mineral oils, and/or coloring additives.

Figure 2:
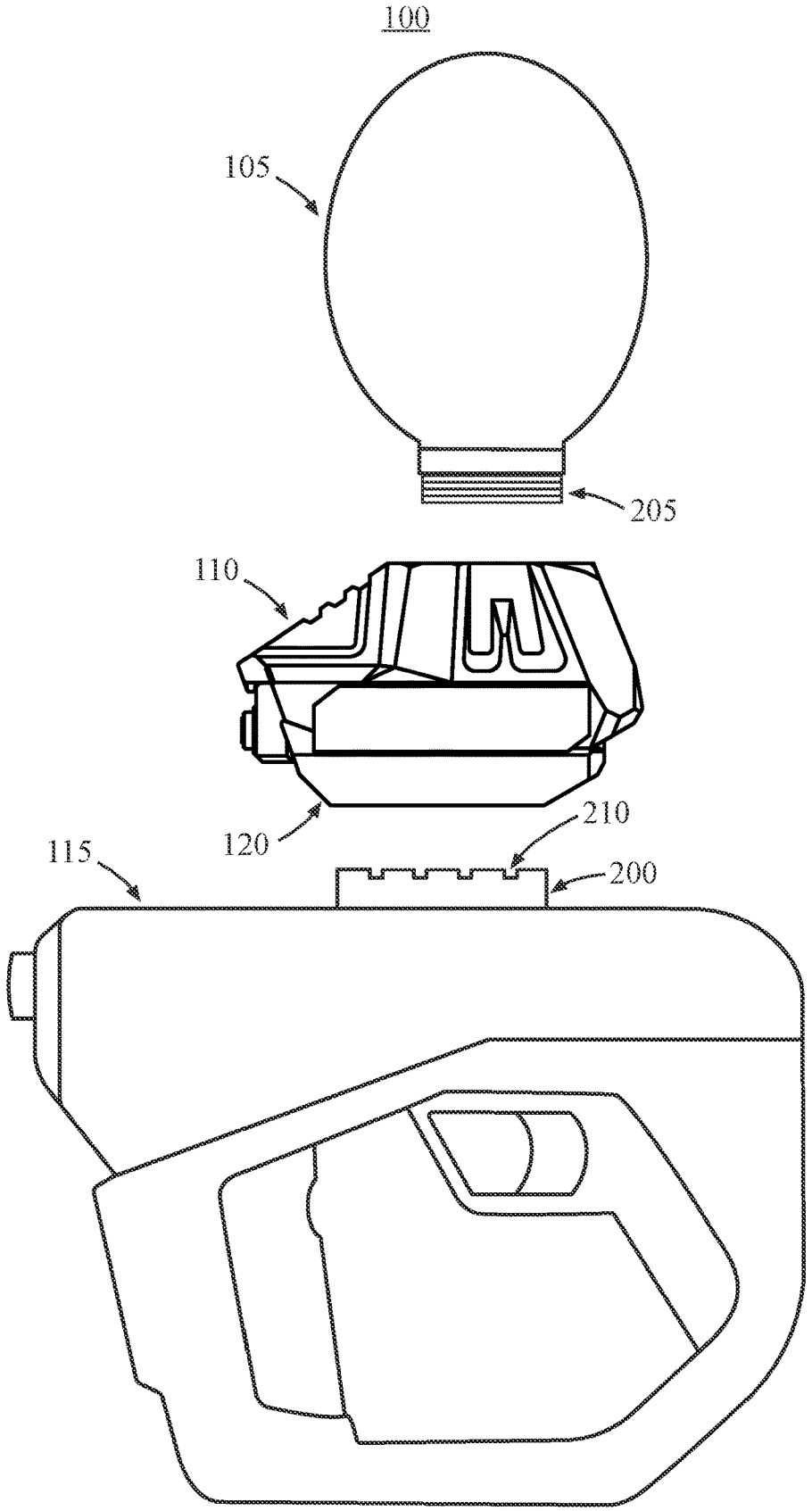
FIG. 2 illustrates a right-side view of a disassembled toy gun assembly of FIG. 1.

FIG. 2 illustrates a right-side view of a disassembled toy gun assembly 100. As described herein, the feed neck module 110 may be removably attach to the loader 105 and the toy gun 115. For example, the feed neck module 110 may have a threaded opening that may attach to a threaded opening 205 of the loader 105. Thus, a user may be able to quickly screw or unscrew the loader 105 into or out of the opening 205 of the loader 105. In some embodiments, the loader 105 is attached to the feed neck module 110 via a snap-fit joint that may include a quick release 500 (see FIG. 5B). Thus, a user may be able to detach the loader 105 without using any tools by, for example, pressing a button, pulling a lever, or removing a pin. In some embodiments, the loader 105 may be attached to the feed neck module 110 via an interference or compression fit, one or more magnets, one or more fasteners (e.g., set screw, thumb screw, etc.), and/or a rail.

When the loader 105 is attached to the feed neck module 110, the opening 205 of the loader 105 may align with an opening of the feed neck module 110. Thus, when the loader 105 is attached, the projectiles may travel from inside the loader 105 into a conduit 420 (see FIG. 4) of the feed neck module 110. The conduit 420 may include a funnel 1000 (see FIG. 10). The conduit 420 of the feed neck module 110 will be described in more detail below.

In some embodiments, the feed neck module 110 may have a mounting bracket 120 that may be removably attach to a rail 200 of the toy gun 115. The rail 200 of the toy gun 115 may be a straight mounting bracket. For example, the rail 200 may be T-shaped in cross-section (e.g., a raised strip with recessed sides), and the mounting bracket 120 may include two guide rails that extend over the raised strip and extend into the recessed sides of the rail 200. The rail 200 may also, or alternatively, have slots 210 on the top of the rail 200. The slots 210 may be used to position or align the feed neck module 110. In some embodiments, the rail 200 may be a dovetail rail, a picatinny rail, Warsaw Pact rail, Weaver rail, NATO Accessory rail, or any other rail type. Alternatively, or in addition, the rail 200 may be a Keymod rail, M-Lok, or any other rail type that incorporates slots. The rail 200 may be located on the top, side, back, or bottom of the toy gun 115. In some embodiments, the toy gun 115 may have multiple rails 200. For example, the toy gun 115 may have a rail 200 on the top and side. Having multiple rails 200 may allow a user to customize the toy gun 115 with multiple accessories (e.g., the feed neck module 110 and a scope).

Figure 3A:
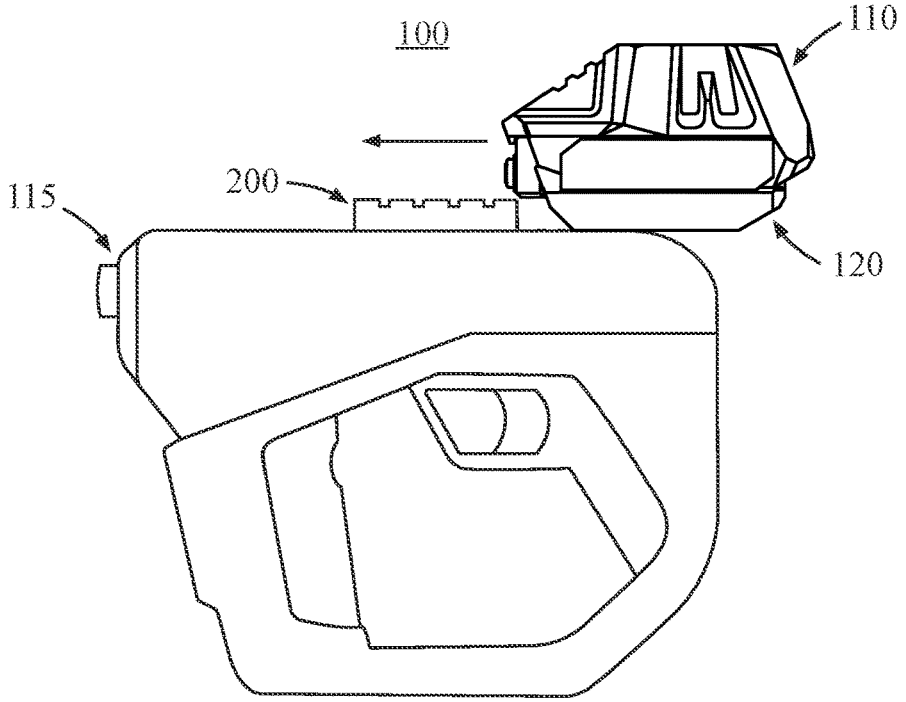
FIGS. 3A and 3B illustrate right-side views of the feed neck module being attached to the toy gun.
Figure 3B:
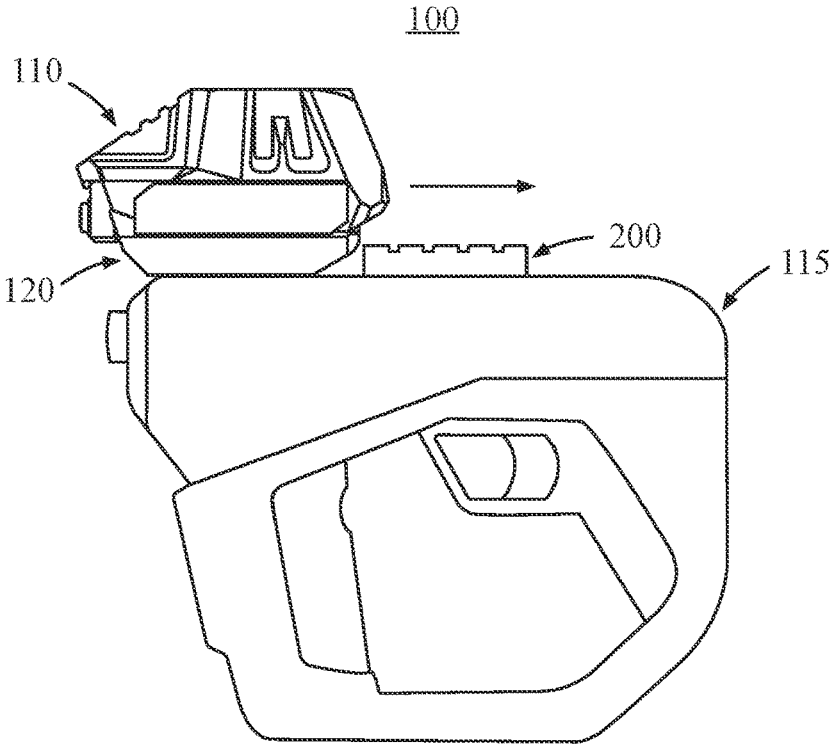

FIGS. 3A and 3B illustrate right-side views of the feed neck module 110 being attached to the toy gun 115. As shown in FIGS. 3A and 3B, the mounting bracket 120 of the feed neck module 110 may slide onto the rail 200 from the front (e.g., the side with the muzzle, shown in FIG. 3B) and/or from the back (e.g., the side with the gunstock, shown in FIG. 3A). Similarly, the feed neck module 110 may be detached from the toy gun 115 by sliding forwards or backwards relative to the toy gun 115. Alternatively, or in addition, the feed neck module 110 may slide onto the rail from the left or right side of the toy gun 115 (e.g., into and out of the page in FIGS. 3A and 3B).

In some embodiments, the feed neck module 110 may be attached to the toy gun 115 via the rail 200 and one or more fasteners. For example, a user may use one or more screws to fasten or lock the position of the feed neck module 110 on the rail 200. In some embodiments, the feed neck module 110 may be attached to the feed neck module 110 via a snap-fit joint that may include a quick release 505 (see FIG. 5B). Thus, a user may be able to detach the feed neck module 110 from the toy gun 115 by pressing a button, pulling a lever, or removing a pin. Alternatively, or in addition, the feed neck module 110 may be attached to the rail 200 via an interference fit, compression fit, and/or one or more magnets.

Figure 4:
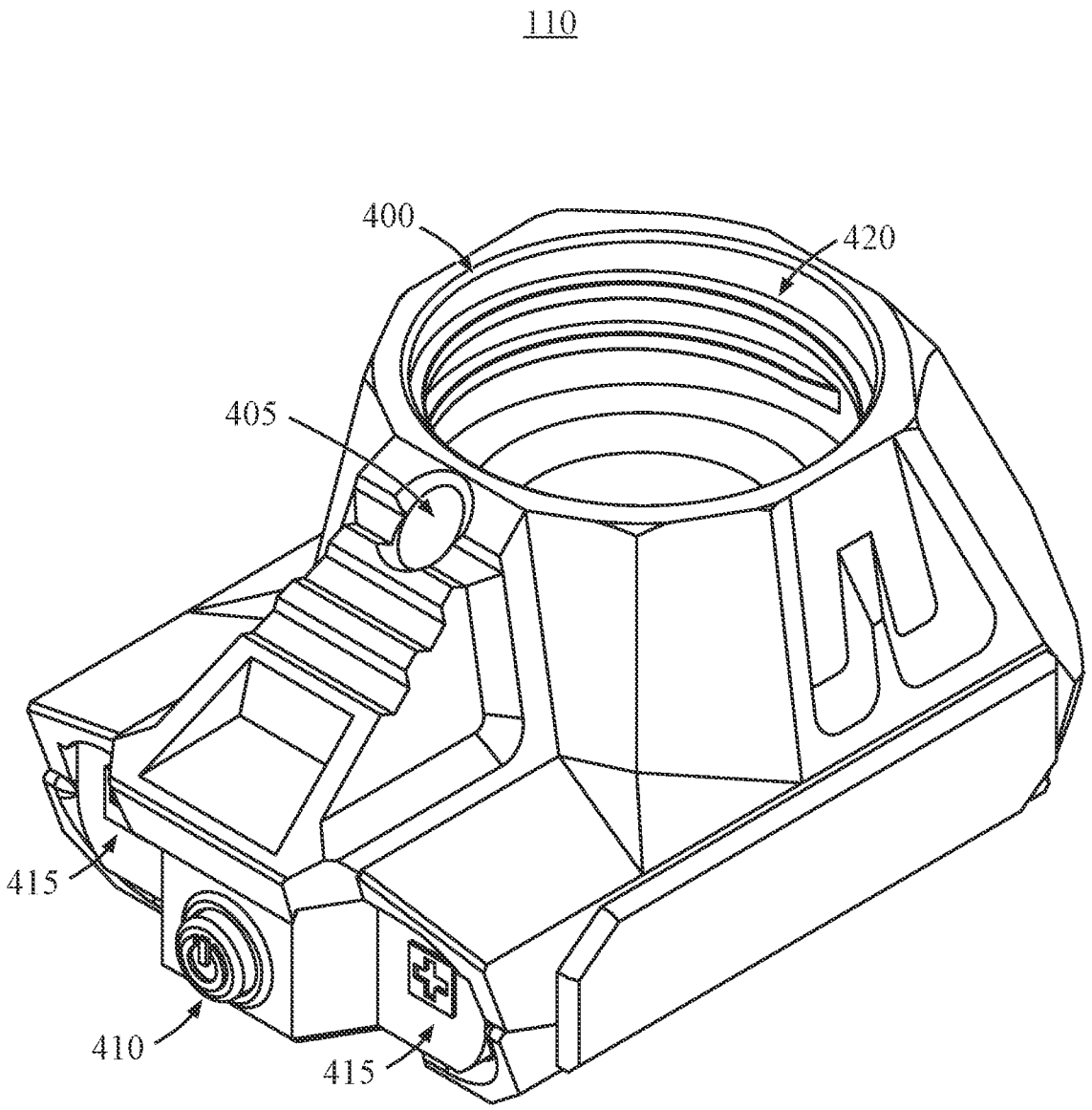
FIG. 4 illustrates a perspective view of the feed neck module of FIG. 1.
Figure 5A:
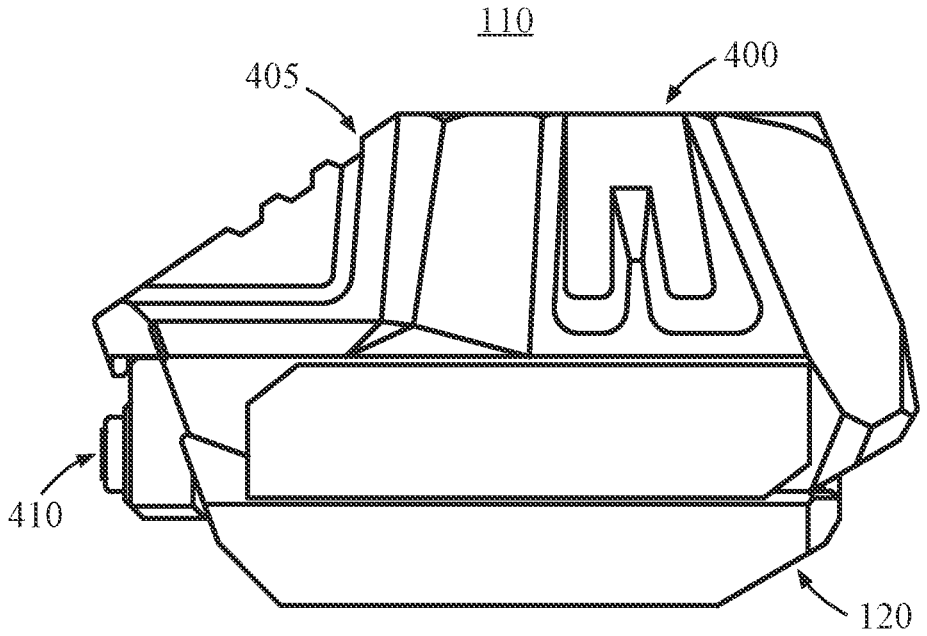
FIGS. 5A and 5B illustrate a right-side view and a left-side view, respectively, of the feed neck module of FIG. 1.
Figure 5B:
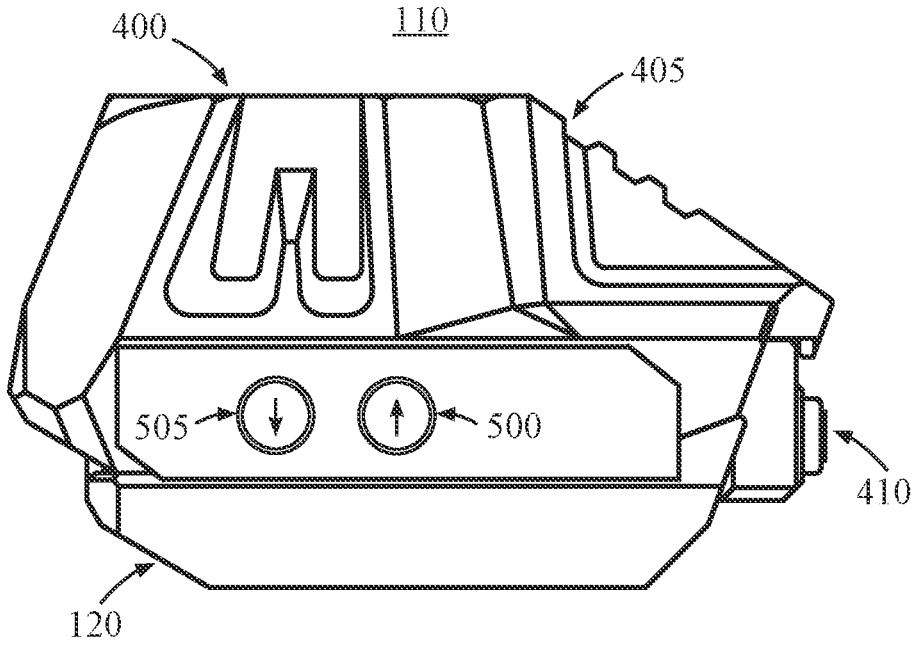

FIGS. 4, 5A, and 5B illustrate a perspective view and side views of the feed neck module 110. As described above, the feed neck module 110 may have an opening 400, and a fastener hole 405. The opening 400 may receive the opening 205 of the loader 105. The opening 400 may be threaded and have a diameter of 5 mm, 8 mm, 15 mm, 20 mm, or more than 20 mm, or any size in between. Furthermore, the fastener hole 405 may be a through hole that may receive a fastener, such as a thumb screw or set screw, to attach the feed neck module 110 to the rail 200. Moreover, the feed neck module 110 may have multiple fastener holes 405.

In some embodiments, the feed neck module 110 may have one or more electronic components (e.g., the light source, sensor, etc.), a power button 410, one or more batteries, and one or more battery compartments 415. The power button 410 may be used to turn the electronic components on and off. In some embodiments, the power button 410 may have multiple positions. For example, the power button 410 may have an on/depressed position where the electronic components may be connected to the batteries). Similarly, the power button 410 may have an off/raised position where the electronic components are disconnected from the battery. In some embodiments, the power button 410 is a switch. Furthermore, the power button 410 may be located on the front center of the feed neck module 110. Alternatively, or in addition, the power button 410 may be placed on the back, side, bottom, or top of the feed neck module 110.

Figure 6:
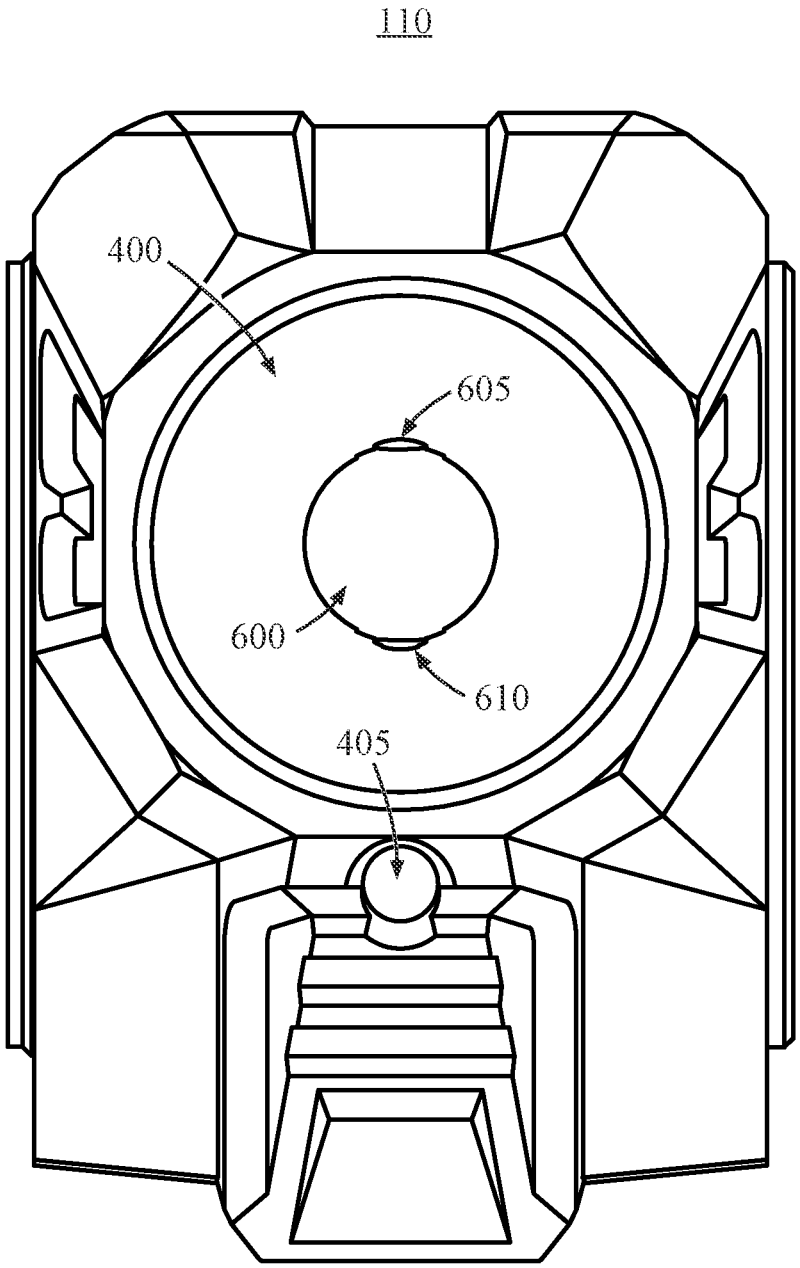
FIG. 6 illustrates a top view of the feed neck module of FIG. 1.

In some embodiments, the power button 410 may be used to configure the electronic components of the feed neck module 110. For example, a user may be able to double tap the power button 410 to change the brightness and/or color of the light source. In some embodiments, the feed neck module 110 may have multiple buttons or switches that allow a user to configure the feed neck module 110 (e.g., configure the electronic components of the feed neck module 110). Furthermore, the feed neck module 110 may have one or more internal batteries (e.g., rechargeable batteries, removable batteries) to power the electronic components. In some embodiments, the user can access the one or more battery compartments 415 to replace a dead battery or to remove a depleted battery so that it can be recharged. For example, the battery compartments 415 may have a cover that slides on and off. Additionally, or alternatively, the feed neck module 110 may have one or more rechargeable batteries and a charging port 900 (see FIG. 9) used to recharge the batteries without removing the batteries from the feed neck module 110. The charging port may be a USB port (e.g., USB-C). In some embodiments, the feed neck module 110 has one or more electrical contacts (not shown)

that connect to the toy gun 115. Thus, the feed neck module 110 may receive power and data from the electrical contacts of the toy gun FIG. 6 illustrates a top view of the feed neck module 110. As described above, the feed neck module 110 may have a light source 605 and a sensor 610. The light source 605 may charge the luminescent projectiles as they travel through the conduit 420 of the feed neck module 110 (e.g., from the opening 400 to the outlet 600). The luminescent projectiles may absorb the light of the light source as they pass through the feed neck module 110. In some embodiments, the light source 605 may cause the loader 105, feed neck module 110, and/or toy gun 115 to glow. The glowing components may improve the visuals of the components and make it more convenient for a user to use the toy gun assembly 100 in low lighting conditions (e.g., at night). Additionally, or alternatively, the user may also be able to change the color of the light source 605. In other embodiments, the light from the light source 605 may not be visible by the user. Furthermore, the user may be able to choose various brightness settings. For example, a user may be able to increase or decrease the brightness of the light source.

The light source 605 may be one or more LEDs, UV LEDs, or lasers. However, other suitable light types can be used. In some embodiments, the light source 605 emits UV light (e.g., light with a wavelength of 200 nm to 400 nm). The UV light may charge the projectiles more quickly than a visible light source (e.g., light with a wavelength of 380 nm to 750 nm). For example, in some embodiments, the light source 605 may fully charge the projectile (e.g., the projectile reaches maximum brightness) before it leaves the conduit 420 of the feed neck module 110. Furthermore, in some embodiments, the light source may provide both UV light and visible light. In some embodiments, the light source 605 may be removable (e.g., via a compartment of the feed neck module 110). Thus, a user may be able to easily replace a broken light source.

In some embodiments, the sensor 610 may automatically turn on the light source 605 when it detects one or more projectiles in the conduit 420 of the feed neck module 110. The sensor 610 may extend the battery life of the feed neck module 110 by turning off the light source 605 when there are no projectiles that need to be charged (e.g., when there are no projectiles passing through the conduit 420. In some embodiments, the sensor 610 is a motion sensor, pressure sensor, a proximity sensor, a light sensor, and/or vibration sensor. For example, the vibration sensor may turn on the light source 605 when it detects that a user is moving (e.g., playing with) the toy gun 115. Alternatively, or in addition, the light source 605 may turn on when a user pulls or has recently pulled the trigger of the toy gun 115. Furthermore, the feed neck module 110 may have multiple sensors 610.

Figure 7:
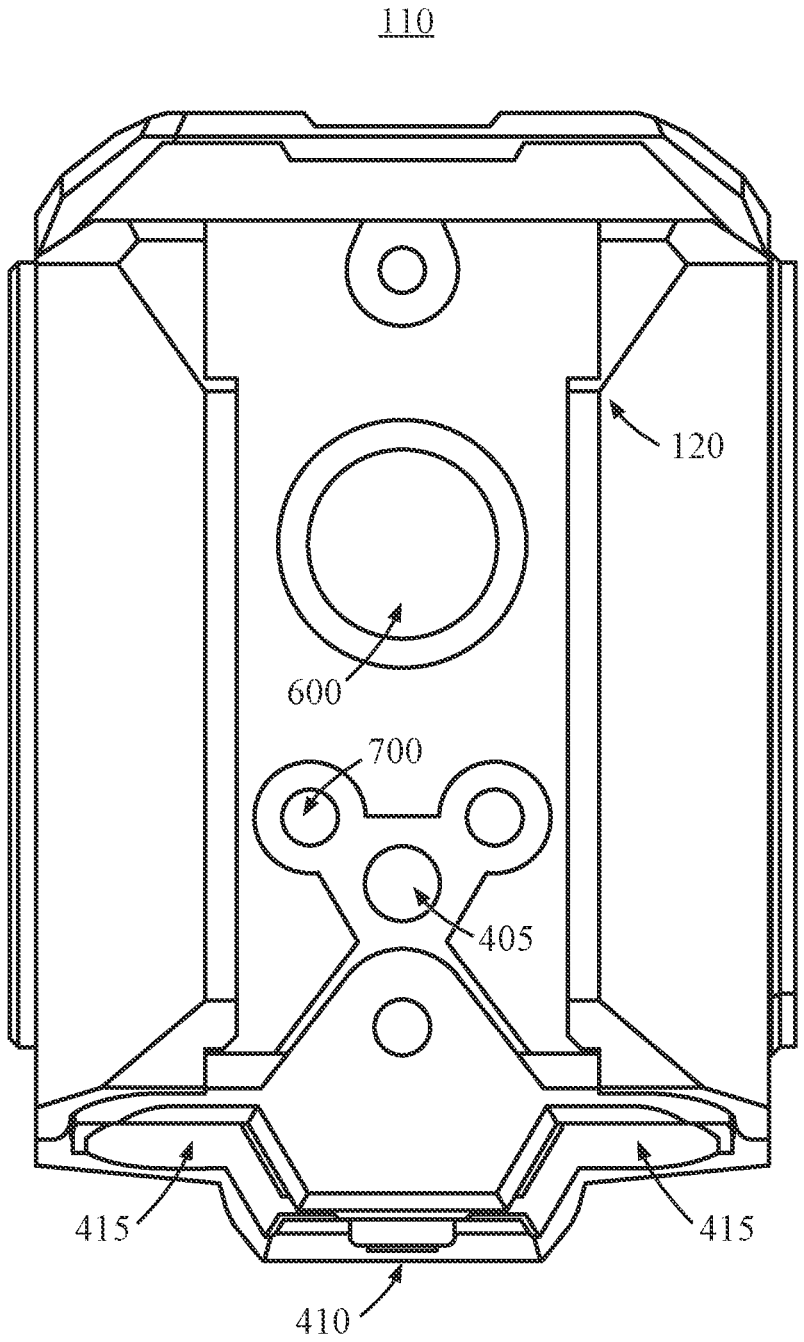
FIG. 7 illustrates a bottom view of the feed neck module of FIG. 1.
Figure 8:
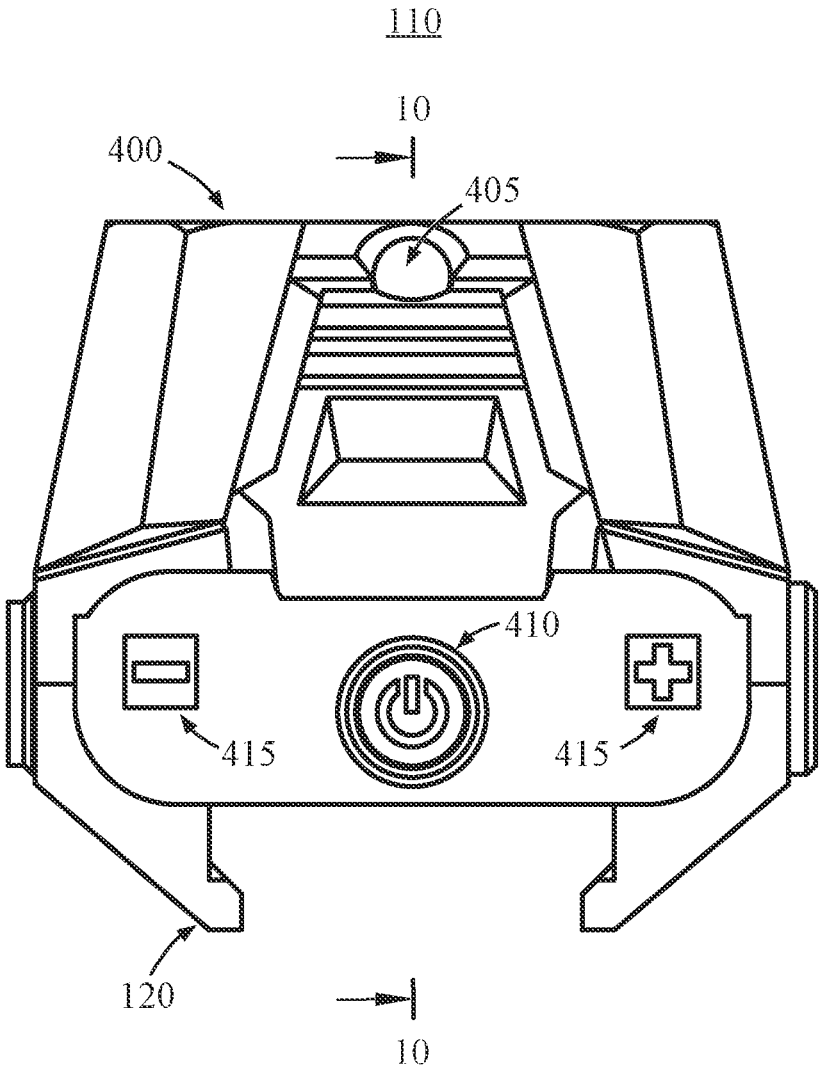
FIG. 8 illustrates a front view of the feed neck module of FIG. 1.
Figure 9:
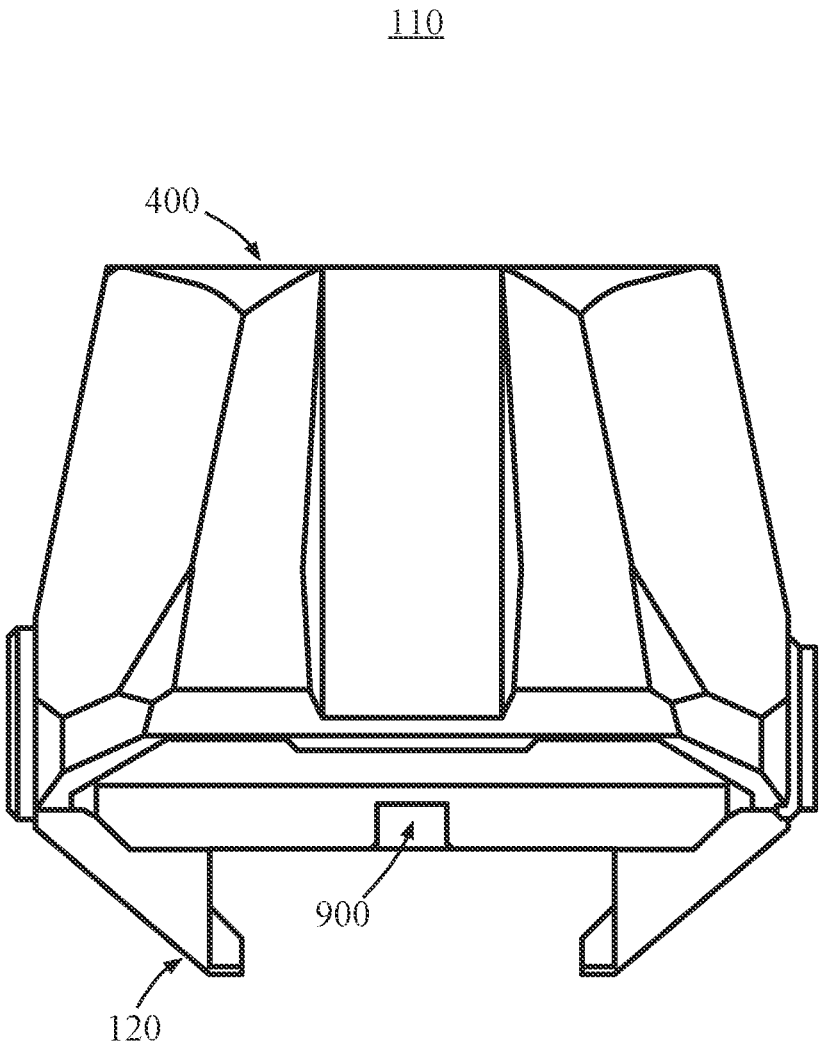
FIG. 9 illustrates a back view of the feed neck module of FIG. 1.

FIGS. 7, 8, and 9 illustrate a bottom, front, and back view, respectively, of the feed neck module 110. In some embodiments, the outlet 600 of the feed neck module 110 may align with the opening of the toy gun (not shown) when the feed neck module 110 is attached to the toy gun 115. Thus, as described herein, the projectiles may travel from the filled loader 105 through the feed neck module 110, and into a chamber of the toy gun 115. The outlet 600 may have a diameter of 2 mm, 5 mm, 8 mm, 15 mm, or more than 15 mm, or any size in between. Moreover, to help with repairs and maintenance, the feed neck module 110 may be disassembled into multiple parts (e.g., a top half and a bottom half). In some embodiments, the feed neck module 110 may have one or more fastener holes 700 for one or more fasteners. The fasteners may be used to attach the top and bottom halves of the feed neck module 110.

Figure 10:
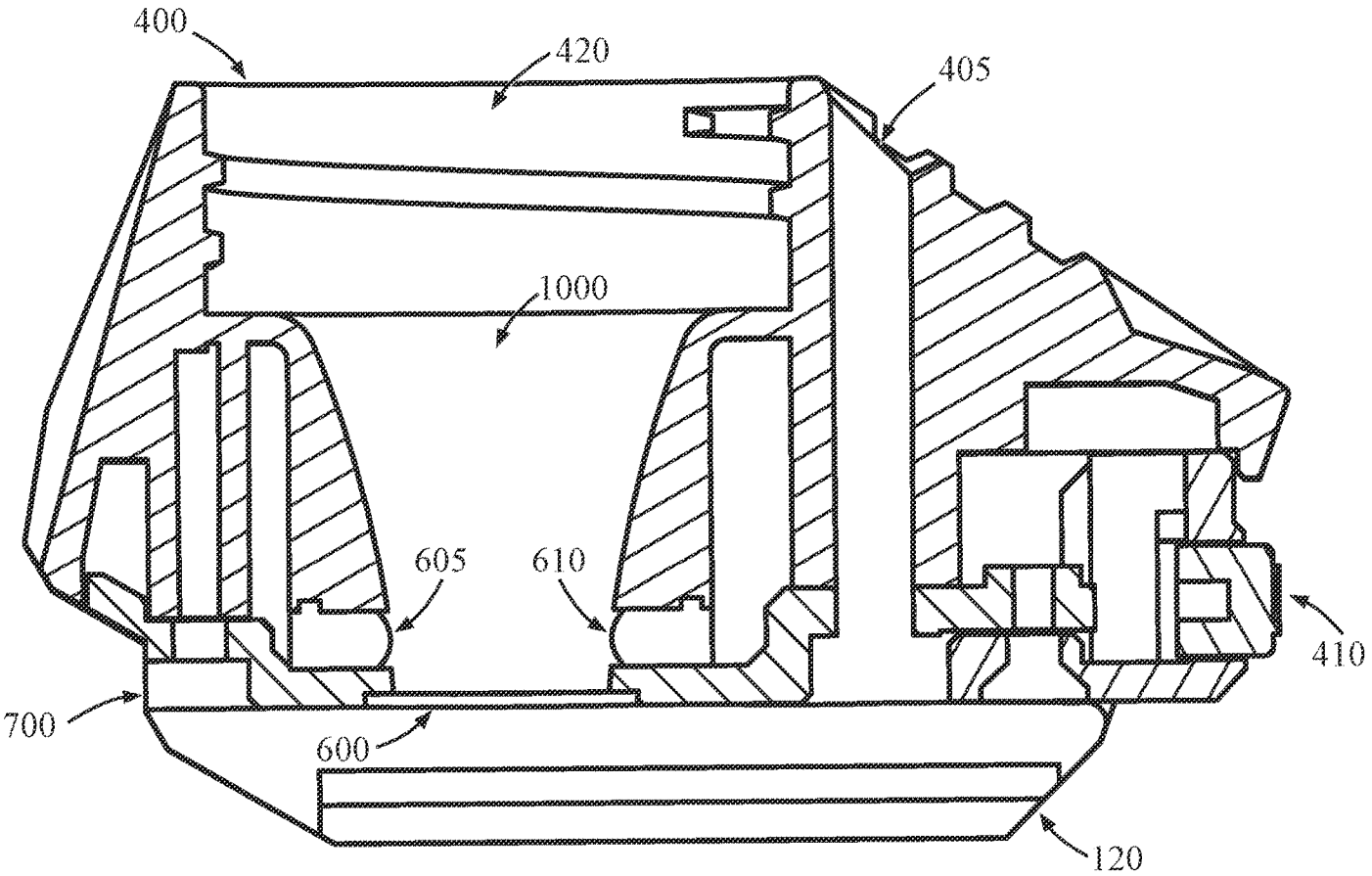
FIG. 10 illustrates a cross section view of the right side of the feed neck module of FIG. 1.

FIG. 10 illustrates a side cross section of the feed neck module 110. In some embodiments, the conduit 420 may include a funnel 1000 to control the flow of projectiles. For example, the opening 400 may be larger than the outlet 600. The curved edges of the conduit 420 may prevent projectiles from jamming inside the feed neck module 110. To further reduce jams, the size of the conduit 420 may limit the number of projectiles that may enter the conduit 420 at the same time. In some embodiments, the opening 400 is 10%, 20%, 30%, 50% or more than 50% larger than the outlet 600. Alternatively, or in addition, the conduit 420 may be cylindrical (e.g., the opening 400 and the outlet 600 are the same size).

In some embodiments, the light source 605 and the sensor 610 are in recesses at the bottom of the conduit 420 and emit light into the conduit 420. Alternatively, or in addition, the light source 605 and sensors 610 may be placed in recesses at the top or middle of the conduit 420. In other implementations, the light source 605 and the sensor 610 can be at different locations relative to the conduit 420 (e.g., the sensor 610 can be closer to the opening 400 and the light source 605 can be closer to the outlet 600. In some embodiments, the conduit 420 may have light sources 605 and sensors 610 along the conduit 420 (e.g., at the top, middle, and/or bottom of the conduit 420). Overall, the feed neck module 110 allows a user to easily connect a loader 105 to a toy gun 115. Therefore, the feed neck module 110 allows projectiles to travel from the loader 105 into the toy gun 115. Where they may be fired or launched by a user. Furthermore, the feed neck module 110 may also charge luminescent projectiles so that a user does not need to pre-charge the projectiles. The luminescent projectiles may glow after they have been fired from the toy gun 115. Thus, the projectiles will be easier to see and track, especially in low light settings.

Additional Embodiments

In embodiments of the present disclosure, a feed neck module for a toy gun may be in accordance with any of the following clauses:

Clause 1. A feed neck module for a toy gun, comprising:

- a housing comprising:
  - an opening configured to removably couple to a loader filled with projectiles;
  - a conduit having a first opening and a second opening, wherein the first opening is configured to align with an outlet of the loader when the housing is attached to the loader so that a projectile can pass through the outlet and into the conduit, and wherein the second opening is configured to align with an opening of the toy gun when the housing is attached to the toy gun so that the projectile can pass through the second opening into the toy gun; and
  - a mounting bracket, wherein the mounting bracket is configured to removably couple to a rail of the toy gun;
- a light source, wherein the light source emits light onto the projectile passing through the conduit, wherein the projectile is made of luminescent material and absorbs the light;
- a sensor configured to activate the light source when the projectile passes through the conduit; and
- a power source configured to power the light source and the sensor.

Clause 2. The feed neck module of any preceding clause, wherein the projectile is made of super absorbent polymers and is configured to burst on impact.

Clause 3. The feed neck module of any preceding clause, wherein the projectile is made of plastic or rubber.

Clause 4. The feed neck module of any preceding clause, wherein the projectile is a sponge ball.

Clause 5. The feed neck module of any preceding clause, wherein the projectile is cylindrical.

Clause 6. The feed neck module of any preceding clause, wherein the light source is an UV LED.

Clause 7. The feed neck module of any preceding clause, wherein the UV LED is configured to fully charge the luminescent material of the projectile.

Clause 8. The feed neck module of any preceding clause, wherein the mounting bracket is configured to slide onto the rail of the toy gun and lock in place via a set screw.

Clause 9. The feed neck module of any preceding clause, wherein the mounting bracket is configured to receive a dovetail rail.

Clause 10. The feed neck module of any preceding clause, wherein the mounting bracket further comprises of a quick release.

Clause 11. The feed neck module of any preceding clause, wherein the power source comprises of a removable battery.

Clause 12. A feed neck module for a toy gun comprising:

a housing comprising:

an opening configured to removably couple to a loader filled with projectiles;

a conduit having a first opening and a second opening, wherein the first opening is larger than the second opening, wherein the first opening is configured to align with an outlet of the loader when the housing is attached to the loader so that a projectile can pass through the outlet and into the conduit, the second opening being configured to align with an opening of the toy gun when the housing is attached to the toy gun so that the projectile can pass through the second opening into the toy gun;

a mounting bracket, wherein the mounting bracket is configured to removably couple to a rail of the toy gun;

a UV LED, wherein the UV LED emits UV light onto the projectile passing through the conduit, wherein the projectile is made of luminescent material and absorbs the UV light;

a power source configured to power the UV LED; and a switch configured to connect the power source to the UV LED when the switch is in a first position.

Clause 13. The feed neck module of any preceding clause, wherein the projectile is made of super absorbent polymers and is configured to burst on impact.

Clause 14. The feed neck module of any preceding clause, wherein the projectile is a sphere with a diameter between 6 mm to 9 mm.

Clause 15. The feed neck module of any preceding clause, wherein the opening is configured to removably couple to the loader via a snap-fit.

Clause 16. The feed neck module of any preceding clause, wherein the mounting bracket is configured to receive a dovetail rail.

Clause 17. The feed neck module of any preceding clause, wherein the mounting bracket is configured to slide onto the rail of the toy gun and lock in place via a thumb screw.

Clause 18. A feed neck module for a launcher of luminescent projectiles, the feed neck module comprising:

a housing comprising:

a top side comprising a threaded opening configured to removably couple to a loader filled with projectiles;

a bottom side comprising of a mounting bracket, wherein the mounting bracket is configured to removably couple to a rail of the launcher; and a funnel having a top opening and a bottom opening, wherein the top opening is configured to align with an outlet of the loader when the housing is attached to the loader so that the luminescent projectiles can pass through the outlet and into the funnel, and wherein the bottom opening is configured to align with an opening of the launcher so that the luminescent projectiles can pass through the bottom opening into the launcher;

one or more UV LEDs positioned towards the bottom side of the housing, wherein the one or more UV LEDs emit UV light onto the luminescent projectiles passing through the funnel, wherein the luminescent projectiles absorb the UV light;

a sensor configured to activate the one or more UV LEDs when one or more luminescent projectiles pass through the funnel;

one or more batteries configured to power the one or more UV LEDs and the sensor; and a switch configured to connect the one or more batteries to the one or more UV LEDs and the sensor when the switch is in a first position.

Clause 19. The feed neck module of any preceding clause, wherein the one or more UV LEDs are configured to fully charge the luminescent projectiles.

Clause 20. The feed neck module of any preceding clause, wherein the mounting bracket is configured to slide onto the rail of the launcher and lock in place via a set screw.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z. Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the devices described herein need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed devices.

What is claimed is:

1. A feed neck module for a toy gun, comprising:

a housing comprising:

an opening configured to removably couple to a loader filled with projectiles;

a conduit having a first opening and a second opening, wherein the first opening is configured to align with an outlet of the loader when the housing is attached to the loader so that a projectile can pass through the outlet and into the conduit via the first opening, and wherein the second opening is configured to align with an opening of the toy gun when the housing is attached to the toy gun so that the projectile can pass out of the conduit and into the toy gun via the second opening; and a mounting bracket, wherein the mounting bracket is configured to removably couple to a rail of the toy gun proximate the opening of the toy gun;

a light source, wherein the light source emits light onto the projectile passing through the conduit, wherein the projectile includes a luminescent material and absorbs the light;

a sensor configured to activate the light source when the projectile passes through the conduit; and a power source configured to power the light source and the sensor.

2. The feed neck module of claim 1, wherein the projectile is made of a material including super absorbent polymers and is configured to burst on impact.

3. The feed neck module of claim 1, wherein the projectile is made of plastic or rubber.

4. The feed neck module of claim 1, wherein the projectile is a sponge ball.

5. The feed neck module of claim 1, wherein the projectile is cylindrical.

6. The feed neck module of claim 1, wherein the light source is an ultraviolet light emitting diode.

7. The feed neck module of claim 6, wherein the ultraviolet light emitting diode is configured to fully charge the luminescent material of the projectile.

8. The feed neck module of claim 1, wherein the mounting bracket is configured to slide onto the rail of the toy gun and lock in place via a set screw.

9. The feed neck module of claim 8, wherein the mounting bracket is configured to receive a dovetail rail.

10. The feed neck module of claim 1, wherein the mounting bracket is configured to removably couple to the rail of the toy gun via a quick release mechanism.

11. The feed neck module of claim 1, wherein the power source comprises a removable battery.

12. A feed neck module for a toy gun comprising:

a housing comprising:

an opening configured to removably couple to a loader filled with projectiles;

a conduit comprising a funnel and having a first opening and a second opening, wherein the first opening is larger than the second opening, wherein the first opening is configured to align with an outlet of the loader when the housing is attached to the loader so that a projectile can pass through the outlet and into the conduit via the first opening, the second opening being configured to align with an opening of the toy gun when the housing is attached to the toy gun so that the projectile can pass out of the conduit and into the toy gun; and a mounting bracket, wherein the mounting bracket is configured to removably couple to a rail of the toy gun proximate the opening of the toy gun by sliding forwards or backwards relative to the toy gun;

an ultraviolet light emitting diode, wherein the ultraviolet light emitting diode emits ultraviolet light onto the projectile passing through the conduit, wherein the projectile includes a luminescent material and absorbs the ultraviolet light;

a power source configured to power the ultraviolet light emitting diode; and a switch configured to connect the power source to the ultraviolet light emitting diode when the switch is in a first position.

13. The feed neck module of claim 12, wherein the projectile is made of a material including super absorbent polymers and is configured to burst on impact.

14. The feed neck module of claim 13, wherein the projectile is a sphere with a diameter between 6 mm to 9 mm.

15. The feed neck module of claim 12, wherein the opening is configured to removably couple to the loader via a snap-fit.

16. The feed neck module of claim 12, wherein the mounting bracket is configured to receive a dovetail rail.

17. The feed neck module of claim 12, wherein the mounting bracket is configured to slide onto the rail of the toy gun and lock in place via a thumb screw.

18. A feed neck module for a launcher of projectiles, the feed neck module comprising:

a housing comprising:

a top side comprising a threaded opening configured to removably couple to a loader filled with projectiles that include a luminescent material;

a bottom side comprising of a mounting bracket, wherein the mounting bracket is configured to removably couple to a rail of the launcher proximate to an opening of the launcher; and a funnel having a top opening and a bottom opening, wherein the top opening is configured to align with an outlet of the loader when the housing is attached to the loader so that the projectiles can pass through the outlet and into the funnel via the top opening, and wherein the bottom opening is configured to align with the opening of the launcher so that the projectiles can pass out of the funnel and into the launcher;

one or more ultraviolet light emitting diodes positioned towards the bottom side of the housing, wherein the one or more ultraviolet light emitting diodes are configured to fully charge the luminescent material of the projectiles by emitting ultraviolet light onto the projectiles passing through the funnel, wherein the projectiles absorb the ultraviolet light;

a sensor configured to activate the one or more ultraviolet light emitting diodes when one or more projectiles pass through the funnel;

one or more batteries configured to power the one or more ultraviolet light emitting diodes and the sensor; and a switch configured to connect the one or more batteries to the one or more ultraviolet light emitting diodes and the sensor when the switch is in a first position.

19. The feed neck module of claim 18, wherein the mounting bracket is configured to slide onto the rail of the launcher and lock in place via a set screw.

20. The feed neck module of claim 18, wherein the one or more batteries are removable.

* * * * *